United States Patent [19]

Teetz

[11] 4,208,975

[45] Jun. 24, 1980

[54] MULTI-HEAD EMBROIDERY MACHINE

[75] Inventor: Wolfgang Teetz, Krefeld, Fed. Rep. of Germany

[73] Assignee: Maschinenfabrik Carl Zangs Aktiengesellschaft, Krefeld, Fed. Rep. of Germany

[21] Appl. No.: 948,202

[22] Filed: Oct. 3, 1978

[30] Foreign Application Priority Data

Oct. 8, 1977 [DE] Fed. Rep. of Germany ..... 2745396

[51] Int. Cl.[2] ..... D05C 5/00; D05C 7/04

[52] U.S. Cl. ..... 112/86; 112/103

[58] Field of Search ..... 112/78, 86, 103, 121.15, 112/102

[56] References Cited

U.S. PATENT DOCUMENTS

| | | | |
|---|---|---|---|
| 2,837,046 | 6/1958 | Carson et al. | 112/102 |
| 3,468,268 | 9/1969 | Rolauffs | 112/86 |
| 3,802,360 | 4/1974 | Rolauffs et al. | 112/86 |
| 3,991,691 | 11/1976 | Bolldorf | 112/90 |

FOREIGN PATENT DOCUMENTS

| | | | |
|---|---|---|---|
| 2742695 | 3/1978 | Fed. Rep. of Germany | 112/102 |
| 45-1108 | 1/1970 | Japan | 112/103 |

*Primary Examiner*—Ronald Feidbaum
*Attorney, Agent, or Firm*—Martin A. Farber

[57] ABSTRACT

A multi-embroidery machine with a common carrier for the individual embroidery frames, the carrier being mounted moveably in the longitudinal axis of the embroidery machine as well as perpendicularly thereto and being adjustable by a pantograph drive; displacement movements of the pantograph drive, which are executed by a pantograph bar (which bar extends parallel to the carrier behind the sewing heads), are transmitted to the embroidery frame carrier by connection struts. For the longitudinal movement of the embroidery frames as well as for the transverse movement, one data carrier-controlled drive each is provided, which data carrier-controlled drives are controlled directly by the pantograph drive, and the displacement movements of the drives are fed to the pantograph bar.

8 Claims, 2 Drawing Figures

Figure 1:
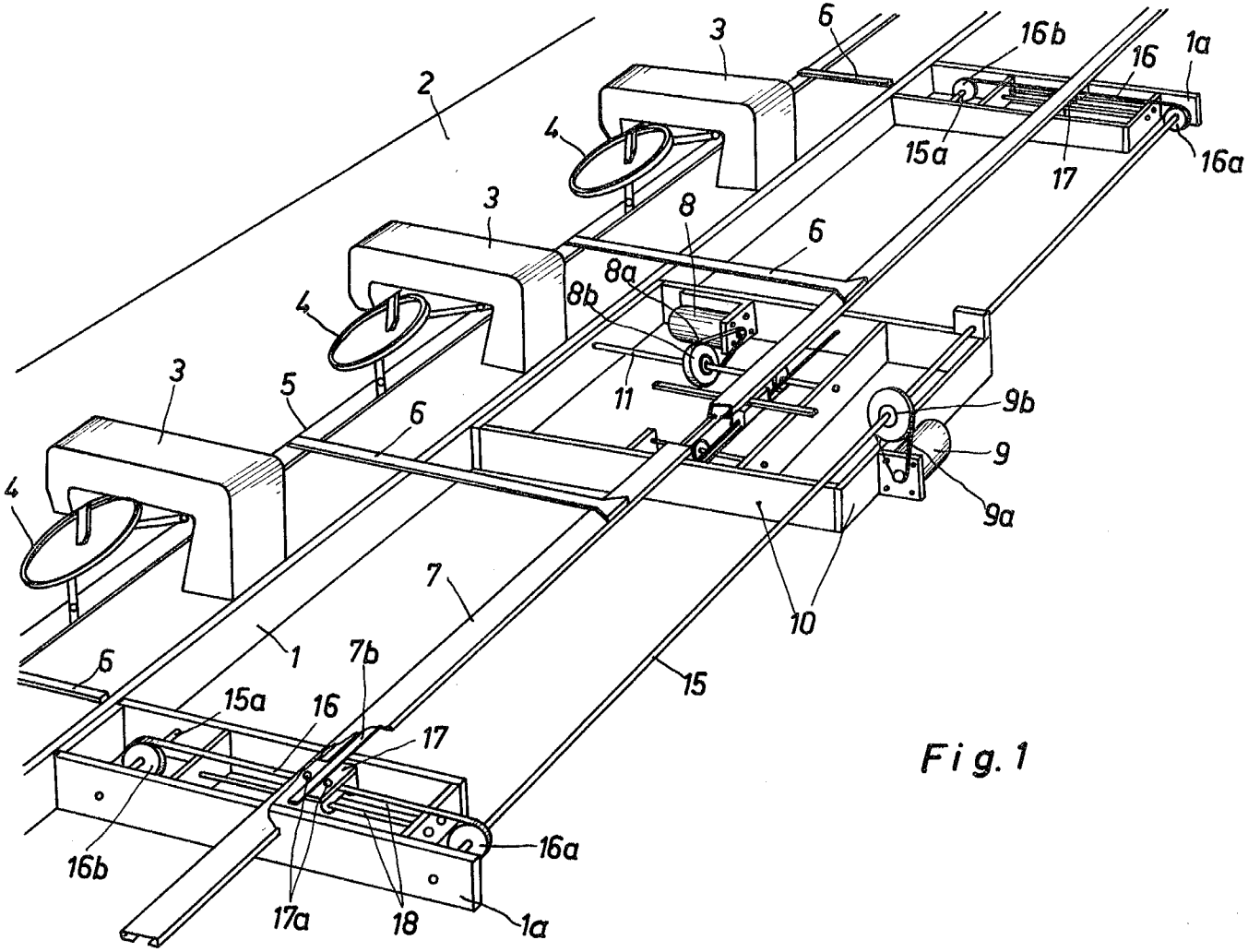

9
9a
9b
10
15
12a
12
13
14
12b
11a
7
13a
7a
11
8
8a
8b
3
5

MULTI-HEAD EMBROIDERY MACHINE

The invention relates to a multi-head embroidery machine with a common carrier for the individual embroidery frames, the carrier being mounted moveably in the longitudinal axis of the embroidery machine as well as perpendicularly thereto and being adjustable by a pantograph drive, displacement movements of the pantograph drive being executed by a pantograph bar (which bar extends parallel to the carrier behind the embroidery heads) are transmitted to the embroidery frame carrier by means of connection struts.

Multi-head embroidery machines of the previously described type are known. With them the drive of the embroidery frame carrier is brought about by means of gear racks, gear wheels and angle levers by means of a single mechanical component mechanism which is arranged outside of the embroidery heads. In this connection it is known to use or mount angle levers between the pantograph drive and the embroidery frame carrier for deflection or change of the drive movement.

The known drives for the embroidery frames of multi head-embroidery machines are not suited for high rotational speeds, that means quick successive embroidery frame movements, since between the gear racks and the gear wheels as well as on the bearing- and connection-positions, already after a short running time there exists a play in the fit due to wear which leads not only to inaccuracies, but also to undesired oscillations. Since the known embroidery frame drives moreover have large masses, such type of oscillations with high speeds of the embroidery machine lead to an unclean execution of the embroidery, since the contours of the individual motifs differ from the required design. There results altogether in this manner a limitation of the working speed of multi heat-embroidery machines, due to defects of the previously used embroidery frame drives.

It is an object on which the present invention is based to make an embroidery frame drive of the introductory described type, which, while avoiding play in the fits and play in bearings and oscillations originating from this, and while using construction parts of small mass, permits a considerable increase of the working performance of multi head-embroidery machines and simultaneously excluding deviations of the embroidered motifs from the required design.

The solution of this object by the invention is characterized in the manner that for the longitudinal movement of the embroidery frames as well as for the transverse movement, each one recording medium or data carrier-controlled drive is provided, which drives are controlled directly by the pantograph drive and their displacement movements are fed to the pantograph bar. According to another feature of the invention each of these drives is formed as a stepping motor.

By the use respectively each of a recording medium-controlled drive, which e.g., is formed as a stepping motor, on the one hand, for production of the longitudinal movements of the embroidery frame, that means the movements in the longitudinal axis of the embroidery machine, and on the other hand for the transverse movements of the embroidery frame, that means for the movements which run perpendicularly to the longitudinal axis of the embroidery machine, there is provided a drive with very low mass, which drive considerably reduces the previous mass moment of inertia of the known drives. Since the stepping motors are directly controlled by the data carrier, e.g., a punch card, a magnetic tape, a magnetic card, or a punched tape, either via an electro-mechanical component mechanism or a corresponding electronic control, with the transmission of the control movement to the pantograph bar, the delay, which was heretofore unavoidable by the mechanical transmission member, is eliminated. Finally the oscillations in the embroidery frame drive, which oscillations heretofore were unavoidable particularly with high working speeds, heretofore due to the bearing play and play in the fits, are eliminated, since the displacement movements of the stepping motors are fed into the pantographic bar play-free and without delay. Electrical, pneumatic or hydraulic motors can be used as stepping motors.

By the inventive formation of the pantographic drive for a multi head-embroidery machine, a play-free movement of the embroidery frame carrier and consequently of the embroidery frames is achieved with rotational speeds of up to 800 rpm, so that there can be achieved a considerable increase in performance or efficiency of the multi head-embroidery machine.

According to a further feature of the invention, the shifting or displacement movements of the stepping motor, the latter causing the longitudinal movement, are fed to the pantograph bar in the longitudinal center of the pantograph bar; for the feeding of the displacement movements of the stepping motor, the latter causing the transverse movement, at least two intermediate drives are provided, which drives act on or engage the pantograph bar at both sides of the centrally arranged stepping motor with the same spacing relative to the latter.

With this formation in accordance with the invention, with a central arrangement of the stepping motors, there is attained a uniform feeding of the displacement movements to the pantograph bar, whereby not being at the proper angle or irregular or nonuniform movements of the embroidery frame carrier are prevented.

With a formation of the embroidery frame drive in accordance with the invention, in the longitudinal center of the pantograph rod there is fastened a drive rail extending perpendicularly to the pantograph rod and in the range of the intermediate drives there is respectively each fastened a drive rail which runs in the longitudinal direction of the pantograph rod, on which rails there engages, respectively, each one drive carriage of the stepping motor. This formation, with simple construction means provides the possibility to feed into the pantographic rod, longitudinal and transverse movements independent of and not influenced by each other.

In order to hold the masses to be moved for execution of the displacement movement as small as possible, according to another feature of the invention, each drive carriage is fastened on the upper strand of an endless, flexible pulling element, e.g. a toothed belt, which pulling element runs between two toothed pulleys or sprocket, of which one pulley is non-rotatably arranged on a shaft, the latter being driven by the associated stepping motor. The toothed belt-transmissions not only have the advantages of a small mass, but also cause a non-slipping and play-free drive.

While according to a further feature of the invention the shaft which causes the longitudinal movement of the embroidery frames is driven by the stepping motor in the direct vicinity of the non-rotatably arranged toothed pulley, the shaft, which causes the transverse movement of the embroidery frames, runs parallel to the pantograph bar over the entire length of the bar, the shaft being driven centrally by the stepping motor and the shaft carrying a number of toothed pulleys, which number corresponds to the number of intermediate drives.

In this manner with multi head-embroidery machines with a very large number of embroidery heads it is possible to drive the pantograph bar and consequently the embroidery frame carrier in the longitudinal direction once centrally and several times in the transverse direction, so that oscillations inside of the embroidery frame-drive elements are prevented.

With a preferred embodiment of the invention, each drive carriage is guided on guide rods which run parallel to the toothed belt and each drive carriage is provided with a least two ball bearings for the engagement on both sides on the corresponding drive rail of the pantograph bar. On the basis of this formation a simple and play-free mounting as well as a transmission of force or power may be achieved, which transmission according to a further feature of the invention finally can be brought about particularly low in friction, in the manner that the drive carriages are guided on the guide rods by means of roller or ball bearings (i.e. antifriction bearing or rolling contact bearing) guides, for example ball bearing bushings.

Figure 2:
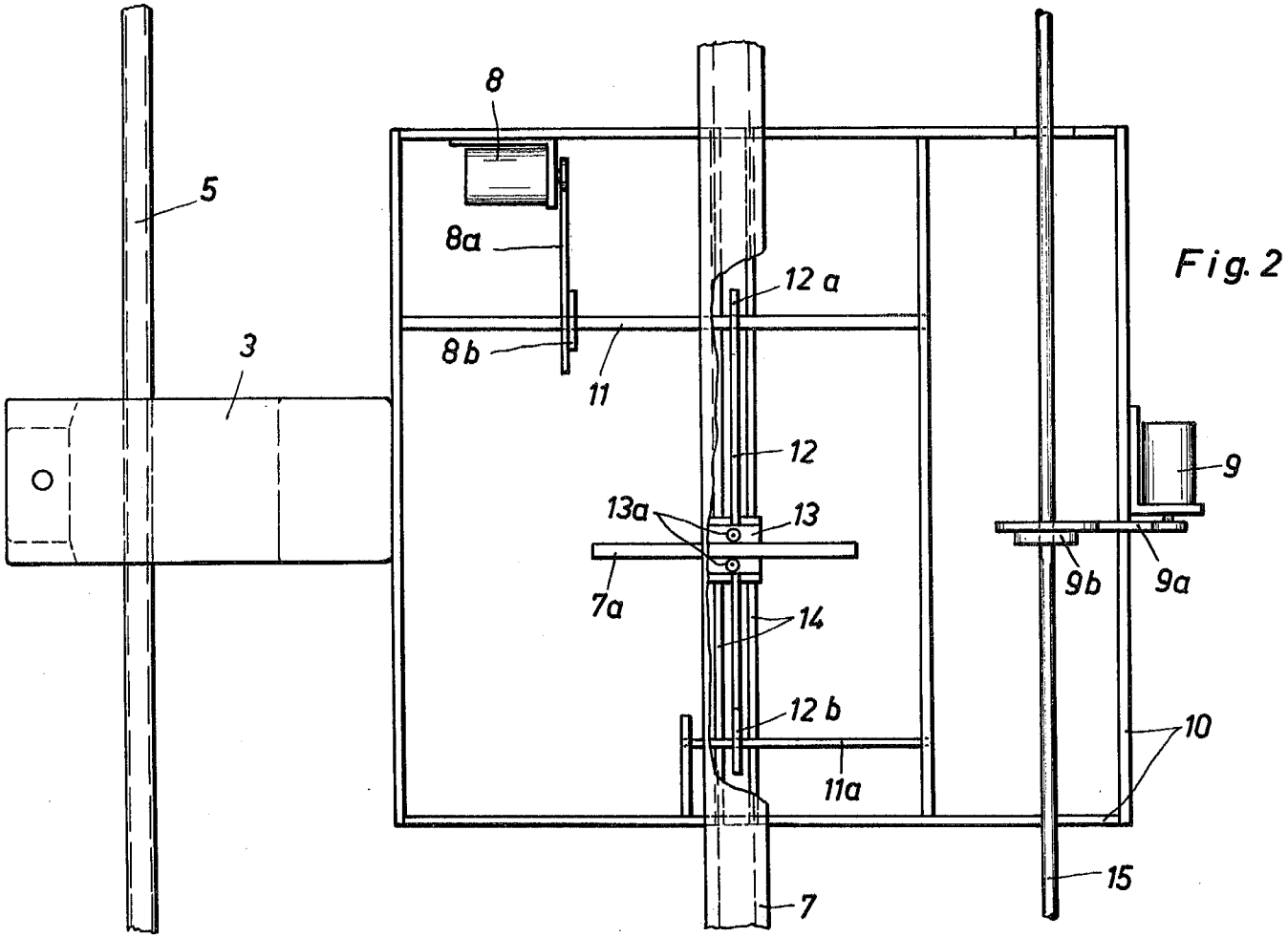

In the drawing one embodiment example of the multi head-embroidery machine is illustrated, and indeed showing:

FIG. 1 a perspective view of the middle part of a multi head embroidery machine; and FIG. 2 a plan view of the center embroidery head and the embroidery frame-drive.

In both figures only the center part of the multi head-embroidery machine is schematically illustrated. A carrier frame-longitudinal carrier 1 is to be recognized, which carrier runs along the back edge of a table top 2. The embroidery heads 3 are arranged on the table top. Of these embroidery heads 3 in FIG. 1, the middle three embroidery heads may be recognized, and in FIG. 2 merely the centermost embroidery head. Each embroidery head 3 is coordinated or associated with an embroidery frame 4. These embroidery frames 4 are secured to a common embroidery frame carrier 5, which carrier 5 consequently extends over the entire length of the multi head-embroidery machine.

This embroidery frame carrier 5 is connected with the pantograph bar 7 by means of connection struts 6, the latter extending between the embroidery heads 3, the bar 7 running behind the embroidery heads 3 also over the entire length of the multi head-embroidery machine. This pantograph bar 7 is controlled by means of a punch card by a non-illustrated pantograph drive, so that the bar executes the longitudinal movements (running in the longitudinal axis of the embroidery machine) as well as the transverse movements (running perpendicularly thereto). These shifting or displacement movements of the pantograph bar 7 as a result of their transmission to the embroidery frames 4 provide the desired embroidery motifs, which are stored in the non-illustrated punch card corresponding to the predetermined design.

The control commands which are stored in this punch card are transmitted either via an electromechanical component mechanism or a corresponding electronic control to two stepping motors 8 and 9, respectively, of which the stepping motor 8 produces the longitudinal movements and the stepping motor 9 produces the transverse movements of the pantograph bar 7.

The stepping motors 8 and 9 are fastened to an auxiliary frame 10. While the rotation movements (which are carried out in both directions of rotation) of the stepping motor 8 are transmitted in the longitudinal center of the pantographic bar 7 as translation movements, the feeding and transformation of the rotation movements of the stepping motor 9 in the pantographic bar 7 are brought about by means of at least two intermediate drives, the latter at both sides of the centrally arranged stepping motor 9 at the same spacing from the motor 9 acting on the pantograph bar 7.

With the illustrated embodiment example, the stepping motor 8 transmits its rotational movement by means of a toothed belt **8*a* to a drive or transmission pulley 8*b*, the latter being non-rotatably disposed on a shaft 11. On this shaft 11, at a small distance from the drive pulley 8*b*, there is fastened a toothed pulley 12*a* for a toothed belt 12. This toothed belt 12 is formed endless and furthermore goes around a toothed pulley 12*b*, the latter being arranged on an axle 11*a*, which axle 11*a* is arranged parallel to the shaft 11**.

A drive slide or carriage 13 is secured on the upper strand or upper portion of the toothed belt 12, the slide being displaceably mounted by means of ball bearing bushings (not illustrated) on guide rods 14 which are circularly-shaped in cross-section. The guide rods 14 run in the longitudinal direction of the embroidery machine and consequently in the longitudinal direction of the pantograph bar 7.

The rotational movement of the stepping motor 8, which rotational movement is controlled by the not illustrated pantograph drive, is transmitted by the toothed belt **8*a* to the transmission pulley 8*b* and consequently to the shaft 11. By the toothed pulley 12*a* which is arranged non-rotatably on the shaft 11, a further transmission of the rotation movement to the toothed belt 12 takes place and consequently to the drive slide 13. On the upper side of this drive slide 13 two ball bearings 13*a* are rotatably mounted on bolts or pins. These ball bearings 13*a* engage or act free of play on opposite sides on a drive rail 7*a*, which drive rail 7*a* is fastened to the lower side of the pantograph bar 7 in the longitudinal center of the pantograph bar 7 perpendicularly to the bar. A rotational movement of the stepping motor 8 in this manner results in a longitudinal movement of the pantograph bar 7. The drive rail 7*a* which is moved via the ball bearings 13*a* of the drive slide 13 permits in this manner a transverse movement of the pantograph bar 7 and indeed independent of the position of the pantograph bar 7** in the longitudinal direction.

The transverse movements of the pantograph bar 7 are produced by means of the stepping motor 9. This stepping motor 9 even stands in connection with a drive pulley **9*b* via a toothed belt 9*a*, the drive pulley 9*b* being fastened on a shaft 15. This shaft 15 extends parallel to the pantograph bar 7 in the longitudinal direction of the multi head-embroidery machine, and with the illustrated embodiment example, is mounted on the transverse struts 1*a*** of the carrier frame.

With the illustrated embodiment, two toothed pulleys **16*a* are non-rotatably arranged on the shaft 15 at the same spacing from the centrally arranged transmission pulley 9*b*. The toothed pulleys 16*a* drive a belt 16. This endless toothed belt runs furthermore over a toothed pulley 16b, the latter being mounted on an axle 15a, the axle running parallel to the shaft 15**.

Furthermore, one drive carriage 17 is respectively fastened to the upper strand or portion of each toothed belt 16. The drive carriage 17 is mounted displaceably on guide rods 18 running parallel to each other. Each drive carriage 17 carries two ball bearings 17a on its upper side, which ball bearings act and engage on a drive rail 7b at both sides without play. These two guide rails 7b extend in the longitudinal direction of the pantograph bar 7 and are secured to the lower side of the bar.

Independent of the longitudinal movement of the pantograph bar 7, which longitudinal movement is produced by the stepping motor 8, the pantograph bar 7 due to the previously described transverse drive can be moved in its transverse direction by means of the stepping motor 9. The rotational movement of the stepping motor 9, which rotational movement is possible in both rotational directions, in this manner is transmitted over the toothed belt 9a and the drive pulleys 9b to the shaft 15. The rotational movement of this shaft 15 is transmitted to the pantograph bar 7 by means of two intermediate drives, whereby self-evidently it is possible, to provide more than two of such type of intermediate drives. With the illustrated embodiment example each intermediate drive comprises the toothed belt 16, the latter being guided over the toothed belt pulleys 16a and 16b, as well as the drive carriage 17, the latter engaging by means of its ball bearings on the corresponding drive rail 7b of the pantograph bar 7.

I claim:

1. In a multi-head embroidery machine with a common carrier for the individual embroidery frames, the carrier being mounted moveably in the longitudinal axis of the embroidery machine as well as perpendicularly thereto and being adjustably by a pantograph drive, displacement movement of the pantograph drive being executed by a pantograph bar (which bar extends parallel to the carrier behind the sewing heads) are transmitted to the embroidery frame carrier by means of connection struts, the improvement comprising first drive means for longitudinally moving the embroidery frames and for being controlled by data medium and directly by the pantographic drive, second drive means for transversely moving the embroidery frames and for being controlled by data medium and directly by the pantographic drive, both said drive means for feeding longitudinal and transverse displacement movements, respectively, to the pantograph bar, said drive means including stepping motors, respectively, said stepping motors include first and second stepping motors, respectively, said first stepping motor constitutes means for feeding the longitudinal movements to the pantograph bar at the longitudinal center of the pantograph bar, said second stepping motor is centrally disposed relative to the length of the pantograph bar and constitutes means for feeding the transverse movements to the pantograph bar, said second drive means further includes at least two intermediate drives operatively connected to said second stepping motor and engaging the pantograph bar at both sides of said second stepping motor at equal distances relative to the latter.

2. In a multi-head embroidery maching with a common carrier for the individual embroidery frames, the carrier being mounted moveably in the longitudinal axis of the embroidery machine as well as perpendicularly thereto and being adjustable by a pantograph drive, displacement movement of the pantograph drive being executed by a pantograph bar (which bar extends parallel to the carrier behind the sewing heads) are transmitted to the embroidery frame carrier by means of connection struts, the improvement comprising first drive means for longitudinally moving the embroidery frames and for being controlled by data medium and directly by the pantographic drive, second drive means for transversely moving the embroidery frames and for being controlled by data medium and directly by the pantographic drive, both said drive means for feeding longitudinal and transverse displacement movements, respectively, to the pantograph bar, a first drive rail fastened to, and in the center of the length of the pantograph bar, said drive rail extends perpendicularly to the pantograph bar, said second drive means includes intermediate drives, second drive rails each extending in the longitudinal direction of and fastened to the pantograph bar in a vicinity of said intermediate drives, respectively, a drive carriage repectively engages on each of said drive rails, one of said drive carriages each being operatively connected to one of said intermediate drives and to one of said second drive rails, said first and second drive means include stepping motors operatively coupled to said drive carriages, respectively.

3. The embroidery machine according to claim 2, further comprising a carrier frame, shafts rotatably mounted in said carrier frame, said stepping motors respectively are operatively drivingly connected to said shafts, respectively, pairs of two pulleys, one of said two pulleys is nonrotatably mounted on said shafts, respectively, endless flexible pulling elements run on and between said two pulleys of each of said pairs, respectively, said pulley elements each defines an upper strand, each said drive carriage respectively is fastened on said upper strand of said pulling elements, respectively, said intermediate drives each includes one of said pairs of two pulleys, one of said drive carriages and one of said pulling elements, respectively.

4. The embroidery machine according to claim 3, wherein said flexible pulling elements are formed as toothed belts and said pulleys are formed as toothed pulleys.

5. The embroidery machine according to the claim 4, wherein one of said shafts constitutes intermediary means for transmitting the longitudinal displacement movements to the embroidery frames from one of said stepping motors via said one of said two pulleys of one of said pairs, one of said upper strands, one of said drive carriages, said first drive rail and said pantograph bar, said one of said stepping motors drives said one shaft in a direct vicinity of said one of said two pulleys of said one of said pairs.

6. In a multi-head embroidery machine with a common carrier for the individual embroidery frames, the carrier being mounted moveably in the longitudinal axis of the embroidery machine as well as perpendicularly thereto and being adjustable by a pantograph drive, displacement movement of the pantograph drive being executed by a pantograph bar (which bar extends parallel to the carrier behind the sewing heads) are transmitted to the embroidery frame carrier by means of connection struts, the improvements comprising first drive means for longitudinally moving the embroidery frames and for being controlled by data medium and directly by the patnographic drive, second drive means for transversely moving the embroidery frames and for being controlled by data medium and directly by the pantographic drive, both said drive means for feeding longitudinal and transverse displacement movements, respectively, to the pantograph bar, shaft means for operatively transmitting the transverse displacement movements to the embroidery frames extends parallel to the pantograph bar over the length of the pantograph bar, said second drive means includes a stepping motor centrally disposed relative to said shaft means, said stepping motor is centrally drivingly connected to the latter, a plurality of toothed pulleys non-rotatably mounted on said shaft means, one intermediate drive means for each of said toothed pulleys operatively engaging the latter, respectively, said second drive means further including said intermediate drive means.

7. The embroidery machine according to claim 3, further comprising guide rods connected to said carrier frame parallel to said pulling elments, respectively, said pulley elements constitute toothed belts, said drive carriage is guided on corresponding of said guide rods, at least two ball bearings mounted on said drive carriage respectively simultaneously engaging both sides of a corresponding of said drive rails, said drive carriage thereby being moveable longitudinally relative to said corresponding drive rail.

8. The embroidery machine according to claim 7, further comprising antifriction bearing guide means for guiding said drive carriage on said corresponding guide rods with little friction.

* * * * *